United States Patent [19]

Camilleri

[11] 4,326,712

[45] Apr. 27, 1982

[54] POSITIVE CYCLE MECHANISM FOR BOWLING PINSETTER

[76] Inventor: Thomas M. Camilleri, 277 Avenue W, Brooklyn, N.Y. 11223

[21] Appl. No.: 156,737

[22] Filed: Jun. 5, 1980

Related U.S. Application Data

[63] Continuation of Ser. No. 898,654, Apr. 21, 1978, abandoned.

[51] Int. Cl.[3] ..... A63D 5/00

[52] U.S. Cl. ..... 273/43 R; 200/61.42; 273/53

[58] Field of Search ..... 273/43 R, 43 A, 53, 273/54 R; 200/61.41, 61.42

[56] References Cited

U.S. PATENT DOCUMENTS

| | | | |
|---|---|---|---|
| 2,045,960 | 6/1936 | Payne | 200/61.42 X |
| 2,801,410 | 7/1957 | Ikeuchi et al. | 200/61.42 X |
| 3,213,225 | 10/1965 | Torres | 200/61.41 |
| 3,514,104 | 5/1970 | Perricone | 273/43 R |
| 4,036,495 | 7/1977 | Blawn et al. | 273/43 R |

FOREIGN PATENT DOCUMENTS

| | | | |
|---|---|---|---|
| 403595 | 6/1966 | Switzerland | 273/53 |

*Primary Examiner*—Anton O. Oechsle
*Attorney, Agent, or Firm*—D. J. Perrella

[57] ABSTRACT

A pinsetter cycling device adapted to be actuated in response to the slightest movement of the pin cushion. The device is constituted by a pair of flexible spring-like conductive members attached to and extending rearwardly of the pit cushion and a conductive surface adapted to be bridged to the flexible members upon the slightest movement of the cushion. The flexible members are electrically connected to the pinsetter cycle means to actuate same on being moved into contact with the conductive surface.

8 Claims, 5 Drawing Figures

POSITIVE CYCLE MECHANISM FOR BOWLING PINSETTER

This is a continuation of application Ser. No. 898,654, filed April 21, 1978, abandoned.

BACKGROUND OF THE INVENTION

In one type of automatic pinsetter bowling machine the force of the bowling ball striking against the cushion is designed to cycle the macine, the specific cycle depending upon whether it is the bowler's first or second ball. This cycling system generally performs satisfactorily with heavy balls, e.g., 14 or 16 pound balls, used by adults, although sometimes a lightly thrown ball will not activate the cycling means. However, when struck by a very light ball, e.g., a 6 or 8 pound ball used by children, the force of the impact is frequently insufficient to cycle the machine. When this happens, the progress of the game is delayed until the pinsetter bowling machine is cycled manually.

OBJECTS OF THE INVENTION

It is an object of the present invention to provide a more sensitive positive cycle means to cycle an automatic pinsetter bowling machine. Another object is to provide a positive cycle means which will cycle an automatic pinsetter bowling machine irrespective of the weight of the ball or the force with which it is thrown. Another object is to provide a cycle means which can be used as an auxiliary system or as the main system. A further object is to provide a cycle means which can be used without disengaging the manufacturer's cycle means. These and other objects of the present invention will be apparent from the following description.

SUMMARY OF THE INVENTION

The cycle means is activated when conductive members attached to the pit cushion complete an electrical circuit in response to the slightest movement of the pit cushion.

DETAILED DESCRIPTION

Figure 1:
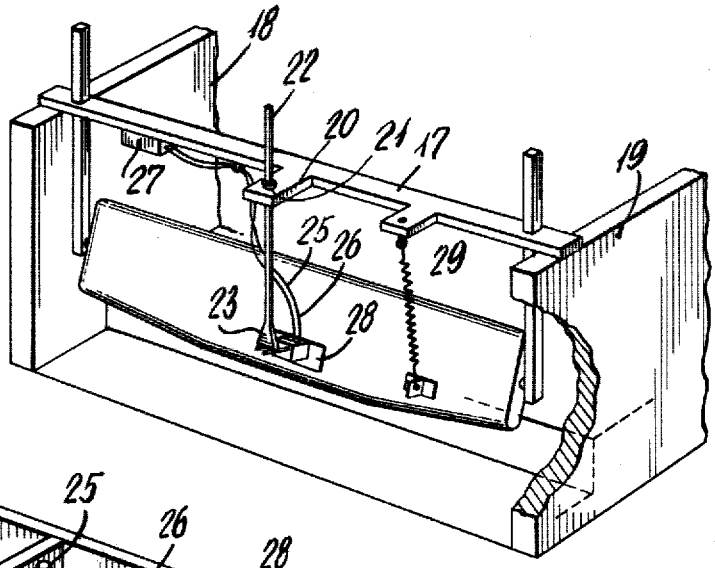
FIG. 1 is a perspective view from the rear of the pit.

The pit cushion 10 of an automatic pinsetter bowling machine is provided with a U-shaped bracket 11 having plate 28 for attaching bracket 11 to pit cushion 10. Plate 28 has two projecting members 12 and 13 which serve as attachments for member 14 which supports two flexible spring-like conductive members 15 and 16 whose free ends project from the front of insert 14. Members 15 and 16 are adapted to be deflected in any direction and to return to their original shape and conformation when the deflecting force is removed.

Support member 17 extends between the two kickbacks 18 and 19. An extending member 20 having a threaded opening 21 is attached to support member 17. A rod 22 is threaded through opening 21. The wider triangularly-shaped lower portion of the rod 22 has a covering of an electrically non-conductive material 23.

The bottom of the wider triangularly-shaped lower portion contains an exposed electrically conductive surface 24 such as a metal bar. Surface 24 is at least long enough to contact simultaneously both of conductive members 15 and 16.

Members 15 and 16 are connected by wires 25 and 26 to time delay module 27 attached to bar 20. Module 27 is connected by wires (not shown) to the activating unit for the original cycling means of the pinsetter. The delay module is adjustable so as to activate the deck immediately or so as to provide a delay of up to about 5 seconds before the deck descends after the first ball to pick up the standing pins before sweeping the fallen pins to the rear after the second ball. An override system in the module renders the unit inoperable in case of a short circuit thus preventing premature cycling.

Figure 2:
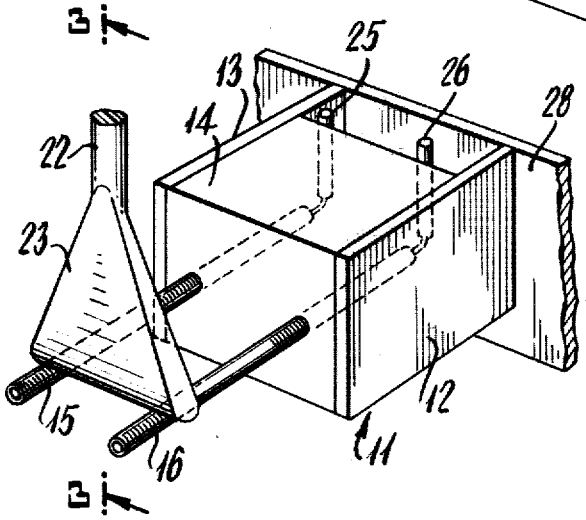
FIG. 2 is an enlarged perspective view of the cycle means.
Figure 3:
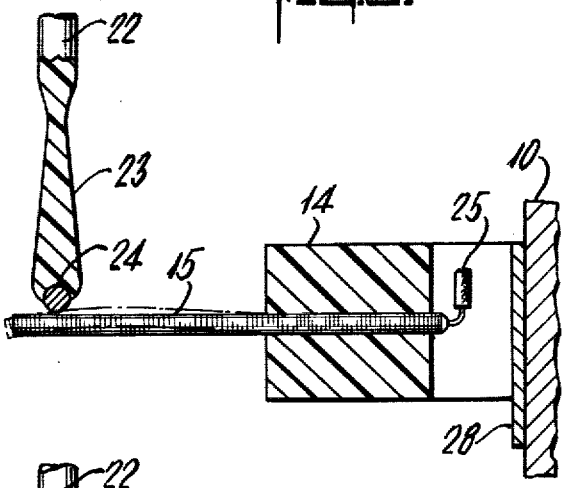
FIG. 3 is a sectional view taken along the line 3—3 of FIG. 2.
Figure 5:
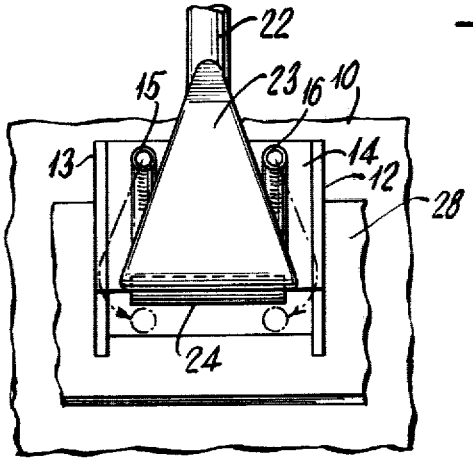
FIG. 5 is a front elevation.
Figure 4:
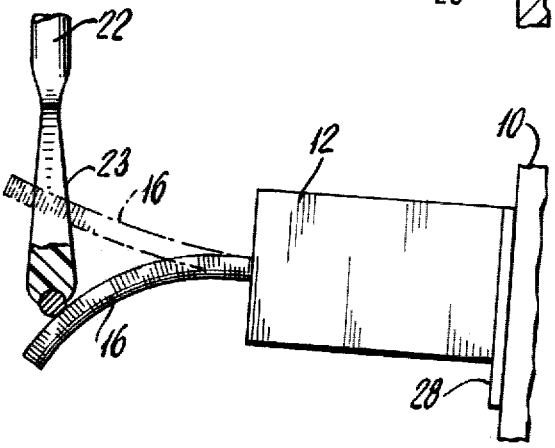
FIG. 4 is a side elevation.

By means of the threaded rod 22, the distance between surface 24 and conductive members 15 and 16 can be made at close as desired, short of actual contact. Then when the pit cushion is moved, however slightly, by contact with a bowling ball, conductive members 15 and 16 contact surface 24 as shown in FIGS. 2 and 3, thereby completing the circuit and positively activating the cycle means. Due to the flexibility of members 15 and 16, as the pit cushion is raised during the cycle, members 15 and 16 are bent downwardly as they pass the wider bottom portion of rod 22 as shown in FIG. 4 but then straighten out as they pass a narrower upper portion as shown in FIG. 5. As the pit cushion moves down again, members 15 and 16 spread out as they ride down the outwardly tapering bottom section of rod 22 and resume their original position as they slip past the bottom of rod 22 as shown by dotted lines in FIG. 5.

It is to be understood that the positive cycling mechanism of the present invention does not replace or supplant the original (manufacturer's) cycling means but functions independently of the original cycling means while being supplementary and complementary thereto. Thus, a lightly thrown ball or a very light ball which would be ineffective to activate the original cycle means will positively activate the cycle means as the slightest movement of the pit cushion will, according to the present invention, cause conductive members 15 and 16 to contact surface 24 thereby completing the electrical circuit which activates the cycle mechanism. The positive cycle mechanism of the present invention may be installed without disengaging the original cycle mechanism. When surface 24 is narrow, in the case of a fast, heavy ball, the contact between the conductive members 15 and 16 and surface 24 may be so brief as to fail to activate the cycle means. In such a case the original cycle means will be activated and will cycle the pinsetter. If it is desired to have the means of the present invention be activated with fast heavy balls as well as light slow balls, the surface 24 may be widened somewhat so as to prolong the time of contact between members 15 and 16 and surface 24.

In the case of an extremely heavy pit cushion which would be moved with difficulty even by a heavy ball, a weight relieving means optionally may be employed. Any means adapted to relieve the weight of the pit cushion so that it moves more readily in response to the impact of the ball may be used. As shown in FIG. 1 the weight of the pit cushion is relieved by a tension spring 29 joining the pit cushion 10 and support member 17. The exact positioning of the weight relieving means is not critical. For example, the tension spring 29 may be positioned at any conventional part of the pit cushion, and need not be positioned in the exact position shown.

A problem with an automatic pinsetter bowling machine having a heavy pit cushion is that the pit cushion supports, termed "hockey sticks" due to their shape, break frequently from the impact of the bowling ball against the pit cushion. This problem is eliminated by the foregoing weight relieving means.

It is also to be understood that various changes and modifications may be made without departing from the spirit of the invention. For example, the locations of surface 24 and members 15 and 16 may be reversed. That is, surface 24 could be located on the pit cushion and members 15 and 16 could be supported from bar 20.

What is claimed is:

1. A positive cycle means for an automatic pinsetter bowling machine comprising first electrically conductive means attached to the pit cushion, the first means adapted to contact a second electrically conductive means in response to movement of the pit cushion thereby completing an electrical circuit adapted to activate the automatic pinsetter bowling machine cycling mechanism, one of the electrically conductive means comprising at least one flexible member, and the other of the electrically conductive means comprising a surface adapted to contact said at least one flexible member, the surface being joined to a member adapted to delect said at least one flexible member in response to movement of the pit cushion.

2. A positive cycle means according to claim 1 wherein said one electrically conductive means comprises at least two flexible members.

3. A positive cycle means according to claim 2 wherein the surface contacts simultaneously the two flexible members.

4. A positive cycle means according to claim 2 wherein the surface is joined to a member adapted to deflect downwardly the two flexible members as the pit cushion rises.

5. A positive cycle means according to claim 2 wherein the surface is joined to a member adapted to deflect outwardly the two flexible members as the pit cushion descends.

6. A positive cycle means according to claim 1 wherein weight relieving means are attached to the pit cushion.

7. A positive cycle means according to claim 6 wherein the weight relieving means comprise tension means.

8. A positive cycle means according to claim 1 wherein the positive cycle means functions independently of the original cycling means.

* * * * *